United States Patent [19]

MacAskill, Jr.

[11] 4,024,412

[45] May 17, 1977

[54] BURNER CONTROL SYSTEM WITH PRIMARY SAFETY SWITCH

[75] Inventor: Robert Bruce MacAskill, Jr., Rockford, Ill.

[73] Assignee: The Scott & Fetzer Company (France Division), Westlake, Ohio

[22] Filed: Feb. 7, 1975

[21] Appl. No.: 547,902

[52] U.S. Cl. ..... 307/117; 431/79

[51] Int. Cl.[2] ..... H01H 37/00

[58] Field of Search ..... 307/117, 116; 431/14, 431/79; 340/227 R

[56] References Cited

UNITED STATES PATENTS

| | | | |
|---|---|---|---|
| 3,732,433 | 5/1973 | Lourigan | 307/117 |
| 3,770,365 | 11/1973 | Lenski | 431/79 |
| 3,829,276 | 8/1974 | Lenski et al. | 431/14 |

*Primary Examiner*—Robert K. Schaefer
*Assistant Examiner*—Morris Ginsburg
*Attorney, Agent, or Firm*—McNenny, Pearne, Gordon, Gail, Dickinson & Schiller

[57] ABSTRACT

A primary side of a burner control circuit includes a triac switch for applying a line voltage to a burner motor and an igniter in response to a signal from a first optical coupler, and a circuit breaker responsive to a second optical coupler for disconnecting the primary from the line voltage. A low voltage or secondary side of the control circuit, which is responsive to a thermostat, contains a light sensitive element for detecting a flame at the burner and the light sources for both optical couplers and, as such, is effective to control both the triac and the circuit breaker. The secondary also contains an electrical timing circuit for causing the triac to shut the motor and igniter off when, a predetermined time after a call for heat by the thermostat has elapsed, a flame has not been detected in the furnace. In addition, the burner control circuit includes a fail-safe capability for opening the circuit breaker if the triac has failed into a permanently closed condition and there is no call for heat or the burner flame has gone out; thereby preventing the system from overheating or filling with fuel.

6 Claims, 1 Drawing Figure

FIGURE 1

BURNER CONTROL SYSTEM WITH PRIMARY SAFETY SWITCH

BACKGROUND OF THE INVENTION

The invention relates to the field of oil burner control systems for furnaces and more particularly to electronic burner control circuits having fail-safe capabilities.

In the prior art systems, specifically represented by Lenski U.S. Pat. No. 3,770,365, and application of Lenski entitled, "Burner Control," Ser. No. 362,387 filed on May 21, 1973, and issued as U.S. Pat. No. 3,829,276 on August 13, 1974 both assigned to the assignee of this application, utilize an electromechanical safety swith in a secondary portion of a control circuit for the purpose of shutting down a burner motor when, after a call for heat by a thermostat, a flame is not detected at the burner within certain time limits. Because the safety switch in these prior systems utilizes a thermal switch for timing, it was not always possible to obtain or predict as precisely as desired, the amount of time that would elapse from a call for heat to the deenergization of the burner motor and igniter in the event a flame was not detected. This uncertainty in timing results from a number of factors including the fact that thermal type switches are particularly sensitive to variations in both line voltages and ambient temperatures, especially for time delays of 10 seconds or more.

In addition, failure of the triac device, controlling the motor and igniter, in a shorted or closed condition, would prevent the burner from switching off when there is no longer a call for heat or permit the furnace to fill with fuel after the burner flame has failed.

SUMMARY OF THE INVENTION

It is therefore an object of the invention to provide an electronic timer circuit to more precisely govern the time between a call for heat and the shutting down of the burner due to failure to detect a flame.

It is another object of the invention to provide a fail safe capability to automatically disconnect the burner motor and igniter from the voltage when the controlling switch has failed in a closed condition.

It is a further object of the invention to provide circuit breaker means for disconnecting the primary circuit from the line voltage after predetermined time has elasped when a flame has not been detected after a call for heat.

It is still another object of the invention to provide a timing circuit, responsive to a call for heat from a thermostat and a light sensitive element for detecting a flame, for activating a circuit breaker in the primary circuit to disconnect the primary circuit from the line voltage when after a predetermined time the flame is not detected.

The burner control circuit is comprised of two major portions; a primary circuit connected to a line voltage which has as its primary function the application of the line voltage to a motor and an igniter of the furnace and a secondary circuit that is responsive to both a thermostat and a light sensitive device for detecting a flame in the burner. The primary circuit includes a triac device, responsive to optically coupled signals from the secondary circuit, for connecting the motor and igniter to the line voltage. In addition, the primary contains a circuit breaker, that includes a heat sensitive element, for causing the primary circuit to open at a predetermined time after current has started to flow through the heat sensitive element. This heat sensitive element is, in effect, controlled by an SCR, that permits current to flow through the heating coil under predetermined conditions. The SCR itself is controlled by a second optical coupler that is responsive to signals generated in the secondary circuit. The secondary circuit is coupled to the primary circuit by means of a transformer which provides a source of low voltage alternating current to the secondary.

The secondary circuit in response to a signal from a thermostat, representing a call for heat, turns on a light generating source of the first optical coupler controlling the triac, thereby having the effect of turning on the burner motor and the igniter. The call for heat signal also activates an electronic timer circuit in the secondary which is set to measure a predetermined amount of time. The electronic timer circuit is also responsive to the flame detecting element and as soon as a flame is detected in the burner, the timer circuit is deactivated. However, if a flame is not detected within the predetermined time as measured by the timer circuit, the timer circuit will turn off the normally "on" light source of the second optical coupler associated with the circuit breaker thus causing the circuit breaker to disconnect the motor and igniter from the line voltage.

In the event that the triac in the primary should short in a closed condition, the SCR controlling the circuit breaker will cause the breaker to open thereby removing the line voltage from the motor. Specifically, if there is no call for heat or a flame is not present in the burner, the optical coupler that controls the SCR will be shut off. This permits a portion of the line voltage, which is being applied to both the motor and the circuit breaker as a result of the shorted triac, to be applied to the gate of the SCR thereby opening the gate and admitting current to the heating coil and causing the circuit breaker to open.

To summarize the operation of the circuit, when the thermostat contacts are open, thereby not calling for heat, the secondary circuit will be unenergized and, as a consequence, the burner motor and igniter will be off. When the thermostat contacts are closed, the burner motor and igniter are connected across the line voltage by means of the triac which, in turn, responds to the optically coupled signal from the secondary circuit. As the igniter generates high energy sparks across the burner, the motor will atomize the fuel flowing across the igniter into the combustion chamber. Closing the thermostat contacts also initiates the electronic timer and, if the fuel is not ignited within a predetermined time, the timer through the optical coupler, will cause the circuit breaker to disconnect the motor and igniter from the line voltage. However, if flame is established before the timer times out, the flame detector will turn off the timer. The electronic timer will remain inactive as long as the flame detection means detects a flame and the thermostatcontacts are closed. Should the flame be lost in the burner, the flame detection means will reactivate the timer and if the flame is not reestablished within the predetermined time, the circuit breaker in the primary will again open. As described before, if the triac controlling the line voltage in the primary is shorted and the thermostat contacts are open, the circuit breaker will respond to these conditions and remove the line voltage from the burner motor and igniter.

DETAILED DESCRIPTION OF THE INVENTION

Figure 1:
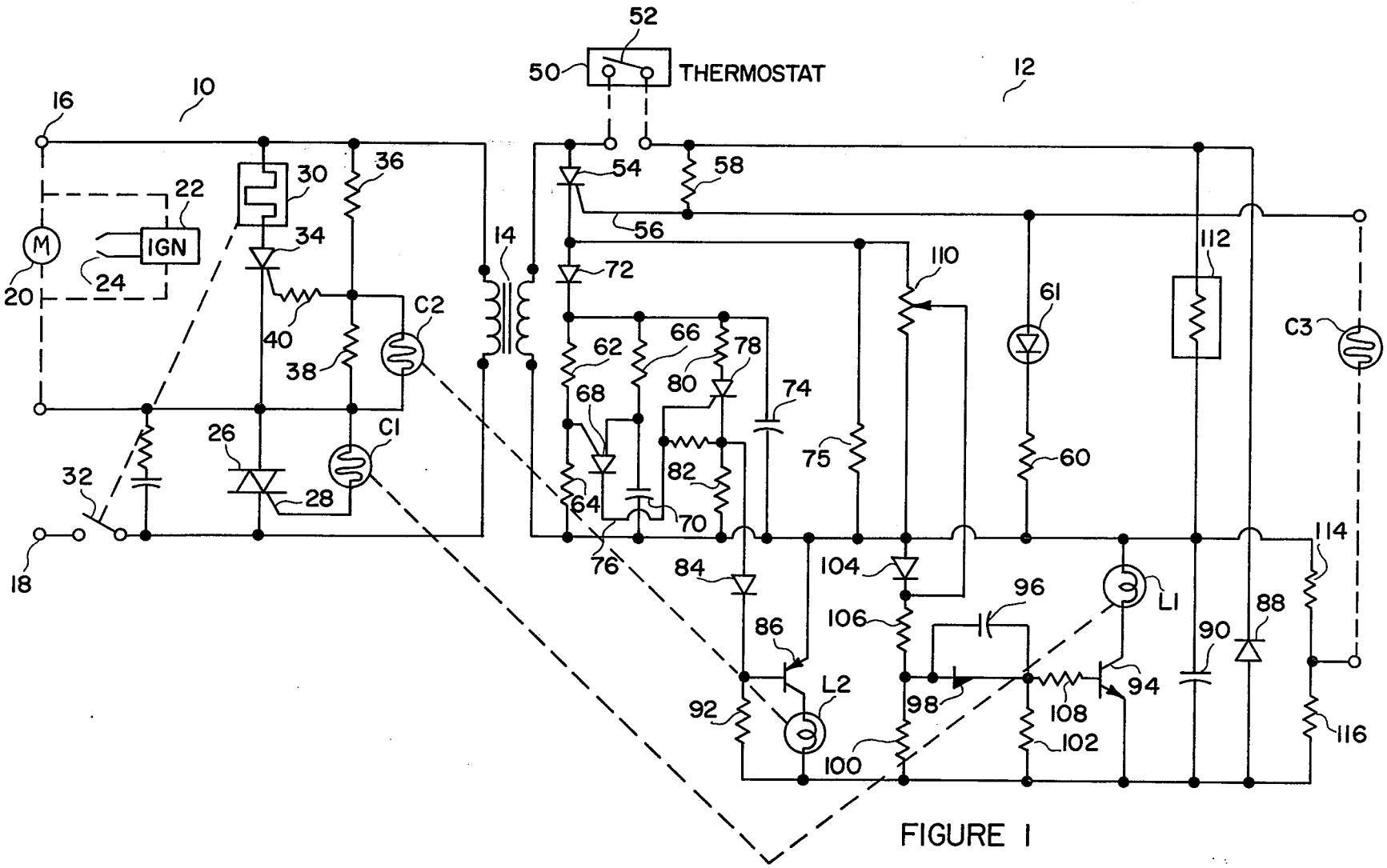
FIG. 1 is a schematic diagram of the burner control circuit.

As shown in FIG. 1, illustrating the preferred embodiment of the invention, a primary side 10 of a burner control circuit is coupled to a secondary side 12 by means of a transformer 14. The primary circuit 10 will be connected across a line voltage, typically 115—120 volts AC, by terminals 16 and 18. Connected to the primary circuit are burner motor 20 and igniter 22. The function of the motor 20 is to atomize the fuel oil and force it through a spark gap 24 of the igniter 22. Controlling the application of the line voltage across the motor 20 and igniter 22 is a power switch in the form of a triac 26. The triac 26 responds to a turn-on signal and a turn-off signal manifested as a reduced electrical resistance in a light sensitive element C1 of an optical coupler L1-C1 that is connected to its gate 28. In other words, when light is applied to the light sensitive element C1 of the optical coupler or relay element L1-Cl, its resistance is substantially reduced turning on the gate of triac 26, thus allowing the line voltage to be applied across the motor 20 and the igniter 22.

In addition to the triac 26, the primary circuit 10 contains a normally closed thermal circuit breaking device which includes an actuating element such as a heat sensitive element 30 and a switch 32. As is typical of heat sensitive circuit breakers, when a trip current flows through the thermal or heat sensitive element 30, it will gradually heat the element until it reaches a predetermined temperature whereupon it will cause the switch 32 to open. Controlling the heat sensitive element 30 of the circuit breaker is a gate-controlled semiconductor electronic switch such as a silicon controlled rectifier SCR 34. During normal operation of the burner control circuit, the SCR 34 will be in an off state when the triac 26 is opened because a light sensitive photoresistive element C2 of an optical coupler or relay element L2-C2 will be receiving light and thus have a very low resistance. At this point, it is important to note that although the preferred embodiment at the invention is described as using optical couplers such as L1-C1 and L2-C2, the burner control circuit would be fully operative with mechanical or electro-mechanical relays between the primary and secondary. The low resistance of element C2 provides an alternate current path for the current passing through resistor 36 so that a resistor 38 will be bypassed thus resulting in an insufficient turn-on voltage on the control input or gate of the SCR 34 and preventing SCR 34 from conducting. However, when the light sensitive element C2 is not receiving light, its resistance will increase substantially thus causing the current to flow through shunting resistor 38 resulting in a triggering voltage being applied to the gate of the SCR 34 through resistor 40 thus acting as a switch. As a result, when the triac 26 is in a conducting state and when the light sensitive element C2 is not receiving light, voltage will be applied to the gate of the SCR 34 causing it to conduct current thereby providing for a current flow through the heating coil 30. Since the voltage applied to the heating coil 30 will approximate the line voltage, the current flow through the coil 30 will be sufficient to open the switch 32 in the neighborhood of 2 seconds.

The secondary of the transformer 14 provides the secondary side 12 of the circuit with, in the preferred embodiment, approximately 12 volts AC. Responding to a call for heat, switch contacts 52 of the thermostat 50 close, thereby serving to energize the secondary side 12 of the circuit. Closing the switch 52 initially results in the opening of an SCR 54 due to a forward biasing voltage applied to the SCR's gate on the line 56 during positive half cycles of the voltage generated across the secondary of the transformer 14. The voltage produced on the gate of the SCR 54 results from the current flow through resistors 58 and 60 and a diode 61. A light sensitive element C3, shown with dashed lines because it is normally not included in the same physical package as the rest of the circuit will, in absence of a burner flame, have a very high resistance. Whenthe resistance of C3 is high, the current flowing through the resistor 58 will result in sufficient voltage on line 56 to trigger the SCR 54. The cell C3 is, in this embodiment, a light sensitive cadmium photoresistive flame detecting cell located adjacent to the burner (not shown) so that the cell C3 is responsive to the presence or absence of a flame at the burner.

With the closing of the thermostat switch 52, an electronic timer consisting essentially of resistors 62, 64 and 66, a voltage comparator 68 and a capacitor 70 is activated. A diode 72 in combination with a capacitor 74 provides a DC power source for the timing circuit. A resistor 75 attached to the cathode side of the SCR 54 provides an AC idler current path so as to permit sufficient current flow for the proper operation of the SCR 54. The voltage comparator 68 which, in the preferred embodiment, is a programmable unijunction transistor, functions by comparing the voltage across resistor 64 of the voltage divider comprised of the resistors 62 and 64 and the voltage developed across the capacitor 70. The gate of the comparator 68 is connected between resistors 62 and 64, and as a result will have a constant voltage applied thereto, which in the preferred embodiment is approximately two-thirds of the DC voltage, or approximately 8 volts. When the voltage on the capacitor 70 builds to a point where it is greater than the voltage on the gate of the comparator 68, the comparator 68 will conduct a fairly substantial current for a few milliseconds on line 76. By selecting the appropriate values for the resistors 62, 64 and 66 along with the capacitor 70, a predetermined time, for example, on the order of 20 seconds, will lapse before the comparator 68 conducts.

When the voltage comparator 68 conducts, indicating that the electronic timer has timed out, the current on line 76 will have the effect of latching open an SCR 78. When the SCR 78 is latched in an "on" condition, current flowing through resistor 80 generates a voltage across resistor 82 that is equal to the ratio of the resistor 80 over resistor 82. This voltage is then transmitted through diode 84 to the base of a transistor 86.

Generally, after the thermostat switch 52 is closed,- the transistor 86 will be in an "on" condition due to the fact that a rectification diode 88 in combination with a filter capacitor 90 will serve to apply a DC voltage across the collector and emitter of the transistor 86. When forwardly biased in this manner, the transistor 86 is in a conducting state permitting current to flow through the lamp L2 of the optical coupler L2-C2. It will be remembered that when the lamp L2 is generating light the corresponding light sensitive element C2 of optical coupler L2-C2 will be in a conducting state thereby having the effect of removing any voltage from the gate of the SCR 34 in the primary circuit 10. However, when the electronic timer times out, as previously explained, the voltage across resistor 82 in combination with the resistor 92 will cause the transistor 86 to switch to a non-conducting state thereby turning off the lamp L2. The switching off of the lamp L2 of the optical coupler L2-C2 will have the effect, in the primary circuit 10, of generating a voltage across the resistor 38 thus opening the SCR 34 and permitting current to flow through the heater of the circuit breaker. The net result of these events is that if a burner flame does not appear before the electronic timer times out, the circuit breaker switch 32 will remove the line voltage from the burner motor 20 and the igniter 24.

The motor 20 and igniter 22 are connected to the line voltage in primary circuit 10 by means of the triac 26 which, in turn, is controlled by the optical coupler C1-L1. The lamp L1 is controlled by a transistor 94 that is rendered into a current conducting mode when the thermostat 50 is closed. The transistor 94 is powered by the rectifier diode 88 and the filter capacitor 90. A switch 98 is a forward breakover device such as a silicon asymmetrical AC trigger which is commercially identified as a ST-4. Part of the AC voltage that results from the conductor or SCR 54 is applied to the base of the transistor 94 through resistor 110, diode 104, asymmetric switch 98 shunted by a capacitor 96 and resistors 106 and 108 associated with a resistor 100 and a resistor 102 immediately upon the closing of the thermostat switch 52 thereby serving to open the triac 26 and start the motor 20 and the igniter 24. A variable resistor or potentiometer 110 provides a means of adjusting the "turn on" voltage for the transistor 94 and hence the triac 26. In this manner, a value representing a minimum line voltage can be selected so that the burner system will not operate below a pre-selected minimum line voltage.

A resistor 112 is selected to provide an anticipator current for the thermostat 50 which, in the preferred embodiment, has a range of 0.2 to 0.4 amps. The resistors 114 and 116 are selected to provide a voltage across the flame detector C3 that is limited so as not to damage the cell, while at the same time allowing sufficient current flow through C3 to allow the SCR 54 to turn off when a flame is detected.

Visual indication of the status of the burner control curcuit is provided by a light emitting diode 61. Whenever the thermostat switch 52 is closed and no flame is visible to the light sensitive cell C3, a small amount of current will flow through the LED 61 and the resistor 60. The LED 61 will normally be lighted during the trial period before the flame is achieved at the burner and provides a useful diagnostic tool for trouble shooting the system.

One of the paramount features of the burner control circuit illustrated in FIG. 1 is the fail safe capability that automatically disconnects the motor 20 and the igniter 22 from the line voltage in the event the triac switch 26 should short in a closed condition. When the thermostat switch 52 is closed, both the lamp L1 and L2 are turned on resulting in the switching on of the triac 26 and the reduction of resistance in the light detector cell C2. As previously discussed, the reduction of resistance in the light detector cell C2 prevents sufficient voltage buildup across the resistor 38 to trigger the SCR 34. The cell C2 will remain on until either the electronic timer times out, indicating that a flame was not produced within the allowed time, or when the thermostat switch 52 is again opened. However, if the triac 26 should short while the thermostat switch 52 is closed, the triac 26 will remain on thereby endangering the system as a whole. This situation is corrected when the thermostat contacts open since L2 will switch off thereby shutting off the light detector cell C2 resulting in a voltage buildup across resistor 38 and turning on the SCR 34. The current passing through the coil or heat sensitive element 30 of the circuit breaker will cause the coil to heat and thus open the circuit breaker 32, thereby removing the primary source and preventing damage to the system as a whole.

I claim:

1. A fail-safe operative electrical power circuit for energizing a load comprising:

a power switch means for alternately connecting and disconnecting an electrical power source to a load in response to a turn-on signal and a turn-off signal applied to said power switch means;

a circuit breaking means operable to electrically disconnect said power source from said power switch means and said load in response to a trip current;

an electronic switch means in electrical series relationship with said power switch means operable to apply said trip current to said circuit breaking mean, said electronic switch means having a control input for switching said electronic switch means between a conducting condition and a nonconducting condition, said trip current being applied to said circuit breaking means when said electronic switch means is in said conducting condition and said off signal is being applied to said power switch means, said power switch means being in a conducting condition; and input means electrically connected to said control input for switching said electronic switch means to a nonconducting condition when said turn-on signal is applied to said power switch means.

2. A fail-safe operative circuit according to claim 1 wherein said input means is a photoresistive element having a resistance value varying between a minimum resistance value and a maximum resistance value.

3. A fail-safe operative circuit according to claim 2 wherein said photoresistive element is approximately at said maximum resistance value when said electronic switch means is in said conducting condition.

4. A fail-safe operative circuit according to claim 3wherein said circuit breaking means includes an actuating element in electrical series relationship with said electronic switch means and said power switch means and a normally closed switch connected between said power source and said load, said actuating element causing said normally closed switch to move to an open non-conductive condition in response to said trip current applied to said actuating element.

5. A fail-safe operative circuit according to claim 4wherein said electronic switch means is a gate-controlled semiconductor device having power terminals including an anode and a cathode and a control input including a gate, one of said power terminals being directly connected to said actuating element, said gate being connected to said photoresistive element.

6. A fail-safe operative electrical power circuit for energizing a load including a fuel burner motor and a fuel igniter, said circuit comprising:

a triac switch alternating between a conducting condition and a nonconducting condition, said triac switch having a triac gate responsive to a turn-on signal causing said triac switch to switch to said conducting condition and to a turn-off signal causing said triac switch to switch to said non-conducting condition said signals being applied to said triac gate;

a thermal circuit breaker having a normally closed switch and a heat sensitive element operable to open said normally closed switch when a trip current flows through said heat sensitive element, said normally closed switch being series connected between an electrical power source and said triac switch;

a gate-controlled semiconductor device in electrical series relationship with said triac switch, said device having a gate for switching said device between a conducting condition and a non-conducting condition, said trip current being provided by said gate-controlled semiconductor device in said conducting condition when said off signal is being applied to said triac gate said triac switch being in said conducting condition; and a photoresistive element connected to said gate, said photoresistive element having a resistance value varying between a minimum resistance value and a maximum resistance value, said photoresistive element being approximately at said maximum resistance value when said gate-controlled semiconductor device is in said conducting condition, said photoresistive element being shunted by a resistor.

* * * * *